US006378516B1

(12) United States Patent
Blount

(10) Patent No.: US 6,378,516 B1
(45) Date of Patent: Apr. 30, 2002

(54) DAMPER-CONTROLLED GAS SUPPLY SYSTEM

(76) Inventor: Golden Blount, 5310 Harbor Town Dr., Dallas, TX (US) 75287

( * ) Notice: Subject to any disclaimer, the term of this patent is extended or adjusted under 35 U.S.C. 154(b) by 0 days.

(21) Appl. No.: 09/648,332

(22) Filed: Aug. 25, 2000

(51) Int. Cl.[7] ..... F24C 3/00; F24B 1/189

(52) U.S. Cl. ..... 126/512; 126/539; 126/286

(58) Field of Search ..... 126/512, 500, 126/504, 285 R, 286, 289, 285 B, 292, 536, 539; 431/20; 236/1 G

(56) References Cited

U.S. PATENT DOCUMENTS

| | | | | | |
|---|---|---|---|---|---|
| 2,488,388 | A | * | 11/1949 | Evans | 126/286 |
| 3,831,582 | A | * | 8/1974 | Mahoney | 126/286 |
| 4,033,713 | A | * | 7/1977 | Nilsson | 126/286 |
| 4,084,743 | A | | 4/1978 | Matthews et al. | 236/1 |
| 4,087,045 | A | | 5/1978 | Matthews | 236/1 |
| 4,117,827 | A | * | 10/1978 | Billmeyer | 126/539 |
| 4,175,695 | A | | 11/1979 | Cresswell | 236/1 |
| 4,254,759 | A | * | 3/1981 | Schmidt | 126/285 B |
| 4,265,217 | A | | 5/1981 | Flaherty et al. | 126/288 |
| 4,294,226 | A | | 10/1981 | Feinberg | 126/286 |
| 4,416,611 | A | | 11/1983 | Zivny | 431/20 |
| 4,570,847 | A | | 2/1986 | Clouser | 236/1 |
| 5,450,841 | A | * | 9/1995 | Whitaker et al. | 126/512 |
| 5,503,550 | A | * | 4/1996 | DePalma | 126/512 |
| 5,772,423 | A | * | 6/1998 | Mandir | 126/512 |
| 5,988,159 | A | | 11/1999 | Blount | 126/512 |
| 6,257,871 | B1 | * | 7/2001 | Weiss et al. | 431/20 |

FOREIGN PATENT DOCUMENTS

| | | | | |
|---|---|---|---|---|
| DE | 1243317 | * | 6/1967 | 431/20 |

* cited by examiner

*Primary Examiner*—Henry Bennett
*Assistant Examiner*—Josiah C. Cocks
(74) *Attorney, Agent, or Firm*—Locke Liddell & Sapp LLP; Monty L. Ross

(57) ABSTRACT

A damper-controlled gas delivery system for use with gas-fired fireplaces, the system having a solenoid valve controlling the supply of gas to a burner, a manipulable damper control lever, and a wire linkage connecting the damper control lever to a switch that controls the supply of electrical power to the solenoid valve, the damper control lever and switch, thereby preventing operation of the burner unless the damper is open.

13 Claims, 1 Drawing Sheet

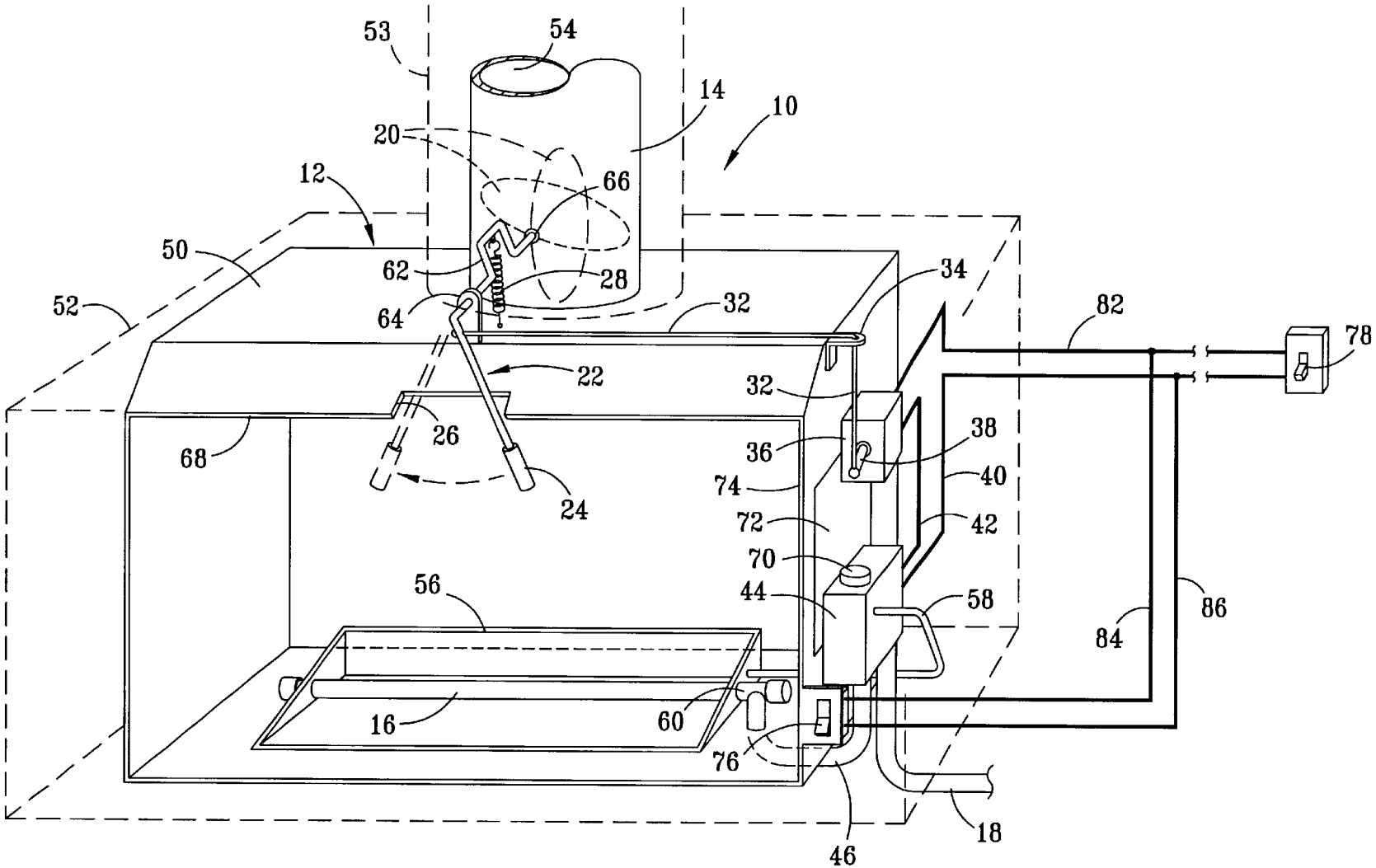
78
86
84
82
18
58
42
40
38
34
46
10
32
36
74
72
70
44
76
60
14
32
66
28
22
24
54
56
16
26
62
64
20
53
12
50
68
52

DAMPER-CONTROLLED GAS SUPPLY SYSTEM

BACKGROUND OF THE INVENTION

1. Field of the Invention

This invention relates to control systems for gas-fired burners in fireplaces and, more particularly, to a system wherein the supply of gas to a fireplace burner can be controlled by manipulation of a damper. The system of the invention is preferably used with fireplaces having a pilot valve lighting system.

2. Description of Related Art

The use of dampers in the vents or stacks of gas-fired furnaces is well known. When a burner is lighted in a furnace, the vent or stack must be open to allow the escape of noxious or lethal fumes produced as combustion byproducts. When a burner is not lighted, however, an open vent or stack allows heat to escape unless a damper is positioned so as to effectively block warm air from rising through it.

Various systems are disclosed in the prior art that are said to be useful for controlling the operation of a furnace damper so that the damper is open when the burner is lighted and closed when the burner is unlighted. Such systems are disclosed, for example, in U. S. Pat. Nos. 4,084,743; 4,087,045; 4,175,695; 4,294,226; 4,416,611 and 4,570,847. U.S. Pat. Nos. 4,084,743, 4,087,045 and 4,570,847 disclose motor operated systems for opening and closing furnace dampers. U.S. Pat. No. 4,175,695 discloses the use of a bimetallic strip in combination with two mercury switches, and U.S. Pat. No. 4,294,226 discloses a thermally actuated control system utilizing a fluid reservoir and piston. U.S. Pat. No. 4,416,611 discloses a system utilizing a thermostat, a solenoid coupled by a spring to a damper control lever, a manual override lever also connected to the damper control lever, a first switch that opens a fuel control valve in response to opening of the damper, and a second switch in parallel with the first switch that is actuated by operation of the manual override lever.

Although many complex systems have been disclosed for use in controlling damper operation in furnaces, most fireplaces with gas-fired burners still rely on manual damper controls. Failure to open a damper when the burner is lighted can cause smoke damage within a residence or business and can be dangerous to the user because of the noxious or toxic gases produced by the fire. Also, because conventional manual damper control levers are often located in the upper portion of the firebox, handling them after the burner is lighted, or soon after the burner is extinguished, can cause burns to the hands and arms of the user. One remote fireplace damper control utilizing a lever assembly accessible outside the firebox is disclosed, for example, in U.S. Pat. No. 4,264,217.

More recently, gas fireplaces have been marketed with pilot valves and burner lighting systems that can be actuated from a switch located on the front of the firebox or, remotely, from a wall switch. Damper control levers have been moved to the front of the firebox, where they are more easily accessible to the user without risk of injury. A need remains, however, for a fireplace gas control system with which the gas burner can be lighted and extinguished simply by manipulating a damper control lever disposed at the front of the firebox between its open and closed positions, respectively. Such a system is disclosed herein.

SUMMARY OF THE INVENTION

The damper-controlled gas system of the invention is preferred for use with gas fireplaces having gas valves with pilot lights that remain burning whether or not the damper is opened. The subject system preferably comprises a rotatable damper mounted inside the chimney vent pipe that is controlled by a transverse rod connected to a lever positioned so as to be conveniently accessible to the user.

According to one particularly preferred embodiment of the invention, the damper control lever hangs down from the top front of the firebox, where it can be manipulated to the left or right to open or close the damper as desired. Manipulation of the damper control lever in either direction causes the transverse rod to rotate the damper inside the chimney, and the rotation of the rod is desirably biased by a spring that is stretched in the over-center position and relaxes when the lever is pushed past the center to either side. A wire linkage preferably connects the damper control lever to a damper switch located outside the firebox so that a translational movement of the damper control lever to either the open or closed position causes the switch to close or open, respectively. A micro-switch is preferred for use in this application because of its smooth operation and reliability. When the damper control lever is in a position where the damper is closed, the open damper switch interrupts the circuit controlling a solenoid valve supplying gas to the main fireplace burner tube. Conversely, when the damper control lever is shifted to a position where the damper is open, the damper switch closes, completing the circuit that allows the solenoid valve to supply gas to the main burner tube, where it is ignited by the pilot light. Unless the damper switch is in the closed position, which can only occur when the damper control lever is positioned so as to open the damper in the fireplace vent, the main fireplace burner cannot receive gas through the solenoid valve, and cannot be lighted.

The present invention therefore provides a simple but reliable positive interlock between the fireplace damper and burner operation that cannot be accidentally forgotten during use, preventing damage to premises or physical injury to users or occupants that might otherwise occur.

BRIEF DESCRIPTION OF THE DRAWINGS

The apparatus of the invention is further described and explained in relation to the drawing FIGURE, which is a front perspective view, partially broken away, of a gas fireplace embodying the damper-controlled gas supply system of the invention.

DESCRIPTION OF THE PREFERRED EMBODIMENTS

Referring to the drawing, damper-controlled gas supply system 10 of the invention is described in relation to a fireplace preferably comprising firebox 12 having chimney vent stack 14 communicating therewith through top wall 50. Firebox 12 and chimney vent stack 14 are desirably installed inside an enclosure 52 and chimney 53 in accordance with conventional construction practices. Burner tube 16 is supported by burner pan 56 inside firebox 12, and receives fuel gas from gas inlet line 46 through solenoid valve 44 and supply line 18. Access to solenoid valve 44 and switch 36, discussed below, is desirably provided through door 72 in side wall 74 of firebox 12. The particular burner configuration is not critical to operation of the invention, and it will be appreciated that the apparatus of the invention is similarly useful, for example, with a burner configuration as previously disclosed by applicant in U.S. Pat. No. 5,988,159.

Electrically (millivolt) actuated solenoid valve 44, which controls the flow of gas from supply line 18 into burner inlet line 46, is depicted in simplified form for illustrative purposes but can be selected from commercially available valves suitable for such use. Most preferably, solenoid valve 44 will further comprise a pilot valve selectively controllable by knob 70, which supplies gas through line 58 to pilot light 60 adjacent to burner tube 16 when knob 70 on top of valve 44 is properly positioned for lighting of the pilot. A spark ignition device can also be provided for use in lighting pilot light 60, but is not shown. Pilot light 60 will desirably burn whether solenoid valve 44 is opened or closed, and facilitates but is not critical to operation of damper-controlled gas supply system 10 of the invention except as further described below in relation to use of the damper control lever 24 or switches 76, 78 for lighting burner 16.

Damper assembly 22 preferably comprises damper 20 disposed inside chimney vent stack 14, damper control rod 62 connected to damper 20, damper control lever 24 connected to damper control rod 62, and tensioning spring 28 connecting damper control rod 62 to top wall 50 of firebox 12. Damper 20 is preferably a metal plate or disc that is rotatably mounted inside chimney vent stack 14 by conventional means to facilitate its opening and closing relative to the flowpath for air and combustion byproducts rising out of firebox 12 that is defined by interior wall 54. In the preferred embodiment depicted in the drawing, damper 20 is connected in fixed relation to damper control rod 62, which is in turn connected in fixed relation to damper control lever 24 that extends downwardly through recess 26 along front edge 68 of top wall 50. When connected as illustrated, sideways manipulation of damper control lever 24 by the user to move it from the position shown in solid outline to the alternative position shown in dashed outline will cause control rod 62 and damper 20 to rotate from a closed position to an open position inside chimney vent stack 14. Tension spring 28 is desirably connected to a bend provided in control rod 62 to exert maximum tension on control rod 62 when in an over-center position. Translational movement of damper control lever 24 by the user from one side to the other within recess 26 causes the tension on spring 28 to increase as the lever moves toward the center, and then relax as the lever moves past the center of recess 26 to the other side.

Damper-controlled gas supply system 10 of the invention preferably further comprises a wire linkage 32 connecting damper control lever 24 to a microswitch 36 that selectively interrupts the flow of electrical current through solenoid valve 44. Solenoid valve 44 is normally closed to prevent lighting of burner 16 when damper 20 is closed. Movement of damper control lever 24 to the position where damper 20 is open causes wire linkage 32 to act on switch lever 38, closing switch 36 to permit the opening of solenoid valve 44. Similarly, movement of damper control lever 24 to the opposite position, where damper 20 is closed, causes wire linkage 32 to release lever 38 to a position where switch 36 is open and solenoid valve 44 will remain in its normally closed position. Wire linkage 32 is preferably made with a relatively stiff wire or cable of small gauge. Wire linkage 32 is desirably made of such material and installed in such manner that translational movement of damper control lever 24 produces an associated movement of switch lever 38 to open or close switch 36 as appropriate. Wire support guide 34 is desirably provided where wire linkage 32 turns the corner of firebox 12 to facilitate smooth movement as switch lever 38 is reciprocated by manipulation of damper shift lever 24. One end of wire linkage 32 is desirably attached to damper control lever 24 by any suitable means such as, for example, by drilling a transverse bore through damper control lever 24 above recess 26, thereafter inserting the wire through the bore and securing the free end to control lever 24. The opposite end of wire linkage 32 is desirably attached to release lever 38 by similar means. Alternatively, any of many commercially available clamps, screws or brackets otherwise satisfactory for this application, or soldering or welding, can likewise be used to attach wire linkage 32 to damper control lever 24 and switch lever 38. Switch 36 is preferably a micro-switch that can be easily and smoothly reciprocated between the open and closed positions in response to movement of damper control lever 24.

Although damper assembly 22 is described herein in relation to a preferred embodiment utilizing a rotatable disc disposed inside chimney vent stack 14, it will be appreciated upon reading the disclosure that the damper-controlled gas supply system 10 of the invention can also be used where damper 20 has a different mechanical configuration such as louvers, or the like, that are selectively opened or closed through a mechanical linkage by a manipulable lever such as damper control lever 24.

Optionally, damper-controlled gas supply system 10 of the invention can further comprise a local switch 76, shown mounted on side wall 74 of firebox 12, and one or more remote switches 78 within the electrical circuit that supplies power to solenoid valve 44. Remote switches 78 can be installed, for example, as wall switches to facilitate convenient lighting of burner 16. Inlet power to solenoid valve 44 is supplied by the pilot thermo-generator, and through switches 36, 76 and 78 connected to solenoid valve 44 by wires 40, 42, 82, 84 and 86 so that normally closed solenoid valve 44 is not opened unless switch 36 and at least one of switches 76, 78 is closed. Switches 76, 78 are desirably wired in parallel to each other and in series to switch 36 to achieve this utility. When configured as shown in the drawing, and assuming that pilot light 60 is in continuous operation and damper 20 is open, switch 36 is closed and burner 16 can be lighted by closing any of switches 76, 78. Alternatively, if any of switches 76, 78 is closed, burner 16 can be lighted simply by moving damper control lever 24 from the "closed damper" to "open damper" position, thereby closing switch 36 and activating the flow of gas to burner 16 through solenoid valve 44. Most importantly, however, burner 16 cannot be lighted at any time by manipulating any of switches 76, 78 unless damper control lever 24 is in the "open damper" position and switch 36 is closed.

The damper-controlled gas supply system 10 disclosed herein affords the user with optimum safety, efficiency and convenience without unnecessary complexity and without requiring the use of timers, thermostats or the like. Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A damper-controlled gas supply system for a fireplace having a firebox and a chimney vent communicating with the firebox, the system comprising:

a burner inside the firebox;

a solenoid valve controlling a flow of inlet gas to the burner;

a damper mounted inside the fireplace chimney vent above the firebox, the damper being selectively positionable to open or close the fireplace chimney vent;

a control rod connected to the damper above the firebox, the control rod being accessible to a user and manipulable between first and second positions corresponding to closed and open damper positions, respectively;

an electrical switch cycling the solenoid valve between off and on positions, the on position permitting the flow of gas to the burner; and a wire linkage disposed outside the firebox and connecting the control rod to the electrical switch, the linkage producing movement of the electrical switch to cycle the solenoid valve between the off and on positions in response to manipulation of the control rod between the first and second positions, respectively.

2. The damper-controlled gas supply system of claim 1 wherein the control rod is spring-biased between the first and second positions.

3. The damper-controlled gas supply system of claim 1, further comprising a selectively pivotable damper control lever that moves the control rod between the first and second positions.

4. The damper-controlled gas supply system of claim 3 wherein the damper control lever is pivotable in translational motion and produces rotational motion of the control rod.

5. The damper-controlled gas supply system of claim 1 wherein the electrical switch is a micro-switch.

6. The damper-controlled gas supply system of claim 1, further comprising a pilot light disposed adjacent to the burner.

7. The damper-controlled gas supply system of claim 1 wherein the wire linkage comprises a stiff wire.

8. The damper-controlled gas supply system of claim 1 wherein the wire linkage comprises a cable.

9. The damper-controlled gas supply system of claim 1 wherein the firebox has a side wall and wherein the solenoid valve is attached to the outside of the side wall.

10. The damper-controlled gas supply system of claim 1 wherein firebox has a side wall and wherein the electrical switch is attached to the outside of the side wall.

11. The damper-controlled gas supply system of claim 9 wherein the solenoid valve is accessible through a door disposed in the side wall.

12. The damper-controlled gas supply system of claim 1, further comprising a second electrical switch mounted adjacent to the firebox, the second switch being manually controllable by the user to cycle the solenoid valve between the on and off positions when the damper is in the open position.

13. The damper-controlled gas supply system of claim 1, further comprising a second electrical switch mounted remotely from the firebox, the second switch being manually controllable by the user to cycle the solenoid valve between the on and off positions when the damper is in the open position.

* * * * *